US010507591B2

(12) United States Patent
Hirata et al.

(10) Patent No.: US 10,507,591 B2
(45) Date of Patent: Dec. 17, 2019

(54) WORKPIECE MANUFACTURING APPARATUS

(71) Applicant: TOYOTA BOSHOKU KABUSHIKI KAISHA, Aichi (JP)

(72) Inventors: Kazuyuki Hirata, Toyota (JP); Taira Ito, Toyota (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/002,066

(22) Filed: Jun. 7, 2018

(65) Prior Publication Data

US 2018/0361609 A1 Dec. 20, 2018

(30) Foreign Application Priority Data

Jun. 20, 2017 (JP) ..... 2017-120490

(51) Int. Cl.
*B26D 7/18* (2006.01)
*B21D 45/10* (2006.01)
*B26F 1/40* (2006.01)

(52) U.S. Cl.
CPC ..... *B26D 7/1818* (2013.01); *B21D 45/10* (2013.01); *B26F 1/40* (2013.01); *Y10T 83/2096* (2015.04); *Y10T 83/9423* (2015.04)

(58) Field of Classification Search
CPC ..... Y10T 83/214; Y10T 83/2074; Y10T 83/2092; Y10T 83/2096; Y10T 83/2109; Y10T 83/2127; Y10T 83/2133; Y10T 83/2135; Y10T 83/2137; Y10T 83/2163; Y10T 83/2166; Y10T 83/5669; Y10T 83/569; Y10T 83/5742; Y10T 83/5769; Y10T 83/9416; Y10T 83/9418; Y10T 83/9423; Y10T 83/9425; Y10T 83/9428; B26D 7/18; B26D 7/1818; B21D 45/10; B21D 45/00; B21D 45/02; B21D 45/04; B21D 45/06; B21D 45/08; B26F 1/40
See application file for complete search history.

(56) References Cited

U.S. PATENT DOCUMENTS

2009/0301161 A1* 12/2009 Fujimura ..... B21D 45/003 72/328
2011/0079122 A1* 4/2011 Hirata ..... B21D 45/003 83/23

FOREIGN PATENT DOCUMENTS

JP 5423302 4/2011

* cited by examiner

*Primary Examiner* — Phong H Nguyen
(74) *Attorney, Agent, or Firm* — Greenblum & Bernstein, P.L.C.

(57) ABSTRACT

A workpiece manufacturing apparatus includes a punch, which is provided in a lower die assembly and punches out a workpiece from an unprocessed material, and an ejector, which is provided in an upper die assembly so as to be capable of approaching and moving away from the lower die assembly. The manufacturing apparatus further includes a spring, which is provided in the upper die assembly and urges the ejector toward the lower die assembly, and a locking device, which locks the ejector with respect to the upper die assembly at a position at which the punch punches out the workpiece and releases the ejector when the die assemblies are opened. The locking device includes an actuator, which is provided in the upper die assembly and slides a slider between a locking position, at which the ejector is locked, and a releasing position, at which the ejector is released.

2 Claims, 6 Drawing Sheets

WORKPIECE MANUFACTURING APPARATUS

BACKGROUND

The present disclosure relates to a workpiece manufacturing apparatus.

The workpiece manufacturing apparatus disclosed in Japanese Patent No. 5423302 manufactures workpieces by punching out the workpieces from an unprocessed material.

The apparatus has an upper die assembly and a lower die assembly, which are arranged on opposite sides of the unprocessed material. The upper die assembly and the lower die assembly move relative to each other in the approaching direction to be clamped and move relative to each other in the direction away from each other to be opened. One of the upper and lower die assemblies is referred to as a first die assembly, which is provided with a punch for punching out a workpiece from the unprocessed material in the clamped state, and the other die assembly is referred to as a second die assembly, which is provided with an ejector capable of approaching and moving away from the first die assembly. The ejector is positioned in correspondence with the punch in the first die assembly and is urged toward the first die assembly by a spring provided in the second die assembly.

In the above-described workpiece manufacturing apparatus, the unprocessed material between the clamped upper and lower die assemblies is held between the punch and the ejector. When the punch punches out the workpiece from the unprocessed material in this state, the punched out workpiece fits into the second die assembly and the ejector is retracted into the second die assembly. The manufacturing apparatus includes a locking device for locking the ejector with respect to the second die assembly in a position where the punch has punched out the workpiece from the unprocessed material. The locking device is configured to release the ejector when the upper and lower die assemblies are opened. When released by the locking device as described above, the ejector is pushed out toward the first die assembly by the urging force of the spring. Accordingly, the workpiece fitted in the second die assembly is ejected.

The locking device disclosed in Japanese Patent No. 5423302 includes a slider provided in the second die assembly. The slider slides between a locking position, where the ejector is locked, and a releasing position, where the lock is released. When the punch punches out the workpiece from the unprocessed material in the clamped state, the slider is pushed by the ejector to move to the locking position. On the other hand, when in the opened state, the urging force of the spring acts from the locking position toward the releasing position. The locking device includes a holding mechanism, which holds the slider when it is slid to the locking position and releases the slider at the locking position. The holding mechanism is arranged outside the upper and lower die assemblies to connect the die assemblies to each other. Also, when the upper die assembly and the lower die assembly are opened with the slider held in the locking position, the holding mechanism operates to release the slider from the locking position in accordance with the opening movement.

In the workpiece manufacturing apparatus, the holding mechanism is arranged outside the upper and lower die assemblies to connect the die assemblies to each other so as to perform the operation of releasing the slider at the locking position in accordance with the opening movement of the upper and lower die assemblies. Therefore, it is necessary to provide a dedicated locking device (holding mechanism) that operates in accordance with the opening movement of each workpiece manufacturing apparatus. For this reason, it is difficult to use a common locking device for multiple manufacturing apparatuses, and the versatility of the locking device is low.

SUMMARY

Accordingly, it is an objective of the present disclosure to provide a workpiece manufacturing apparatus that increases the versatility of the locking device.

Means for solving the above-described problem will now be described.

To achieve the foregoing objectives, a workpiece manufacturing apparatus is provided that includes an upper die assembly and a second die assembly, which are arranged on the opposite sides of an unprocessed material. The upper die assembly and the lower die assembly move relative to each other in the approaching direction to be clamped and move relative to each other in the direction away from each other to be opened. One of the upper and lower die assemblies is referred to as a first die assembly and the other is referred to as a second die assembly. The manufacturing apparatus includes a punch provided in the first die assembly and an ejector provided in the second die assembly. The punch punches out a workpiece from the unprocessed material in a state in which the die assemblies are clamped. The ejector is capable of approaching and moving away from the first die assembly and is located at a position corresponding to the punch. The manufacturing apparatus further includes a spring, which is provided in the second die assembly and urges the ejector toward the first die assembly, and a locking device, which locks the ejector with respect to the second die assembly at a position at which the punch punches out the workpiece from the unprocessed material and releases the ejector when the die assemblies are opened. The locking device includes a slider provided in the second die assembly, an actuator provided in the second die assembly, and a control section, which controls the actuator. The slider can slide between a locking position, where the ejector is locked, and a releasing position, where the lock is released. The actuator slides the slider.

DETAILED DESCRIPTION OF THE PREFERRED EMBODIMENTS

A workpiece manufacturing apparatus 1 according to one embodiment will now be described with reference to FIGS. 1 to 7.

Figure 1:
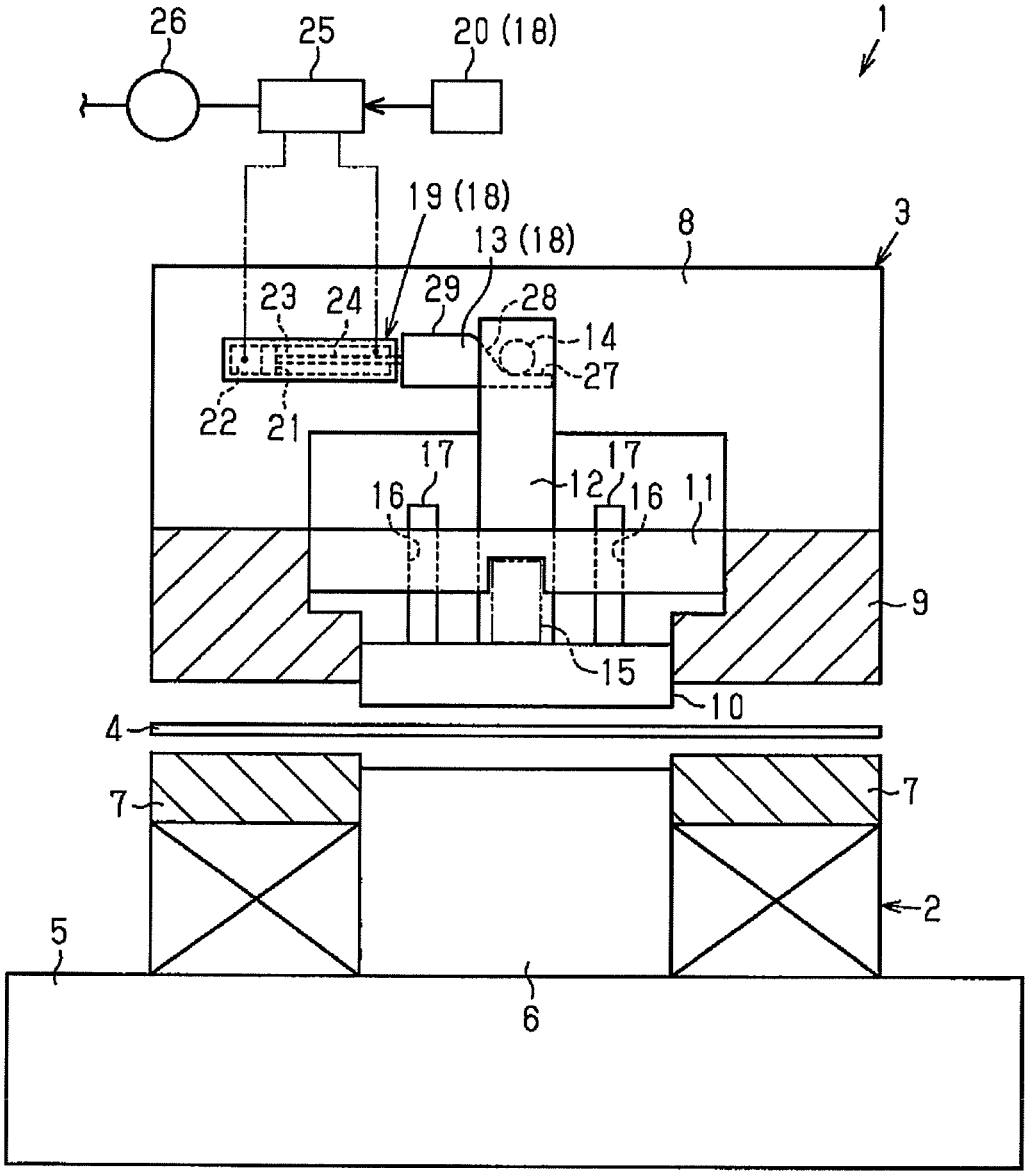
FIG. 1 is a schematic diagram showing a workpiece manufacturing apparatus.

The workpiece manufacturing apparatus 1 shown in FIG. 1 has a fixed lower die assembly 2 and a movable upper die assembly 3. The upper die assembly 3 is located above the lower die assembly 2 and approaches or moves away from the lower die assembly 2 in the vertical direction. An unprocessed material 4, which is a band-shaped metal plate, is transferred to the space between the lower die assembly 2 and the upper die assembly 3. The upper die assembly 3, which is located on the opposite side of the unprocessed material 4 to the lower die assembly 2, is moved downward so that the lower die assembly 2 and the upper die assembly 3 of the manufacturing apparatus 1 are clamped. Then, by moving the upper die assembly 3 upward from the clamped state, the lower die assembly 2 and the upper die assembly 3 of the manufacturing apparatus 1 are opened.

The lower die assembly 2 of the workpiece manufacturing apparatus 1 includes a lower table 5, a punch 6, and a stripper 7. The lower table 5 is fixed to the installation surface of the manufacturing apparatus 1. The punch 6 is fixed to the upper surface of the lower table 5 so as to protrude upward. The stripper 7 surrounds the punch 6 and is movable upward and downward with respect to the lower table 5. The upper end of the stripper 7 is positioned above the upper end of the punch 6 so that the unprocessed material 4, which is transferred to the space between the lower die assembly 2 and the upper die assembly 3, can be placed on the upper end of the stripper 7. In the state in which the clamping is performed by moving the upper die assembly 3 downward, the punch 6 punches out a workpiece from the unprocessed material 4. An example of the workpiece is a separator for use in a cell stack of a fuel cell.

The upper die assembly 3 of the workpiece manufacturing apparatus 1 includes an upper table 8, a die 9, and an ejector 10. The upper table 8 is moved vertically by a lifting device. The die 9 is fixed to the lower surface of the upper table 8 to face the stripper 7 of the lower die assembly 2. The ejector 10 is configured to move vertically in a part of the die 9 that corresponds to the punch 6 of the lower die assembly 2. The ejector 10 approaches and moves away from the lower die assembly 2 by moving vertically in the die 9. The die 9 includes a fixed block 11 fixed thereto and positioned above the ejector 10. A support member 12 protrudes upward from the central portion of the ejector 10 and passes through the fixed block 11.

Figure 2:
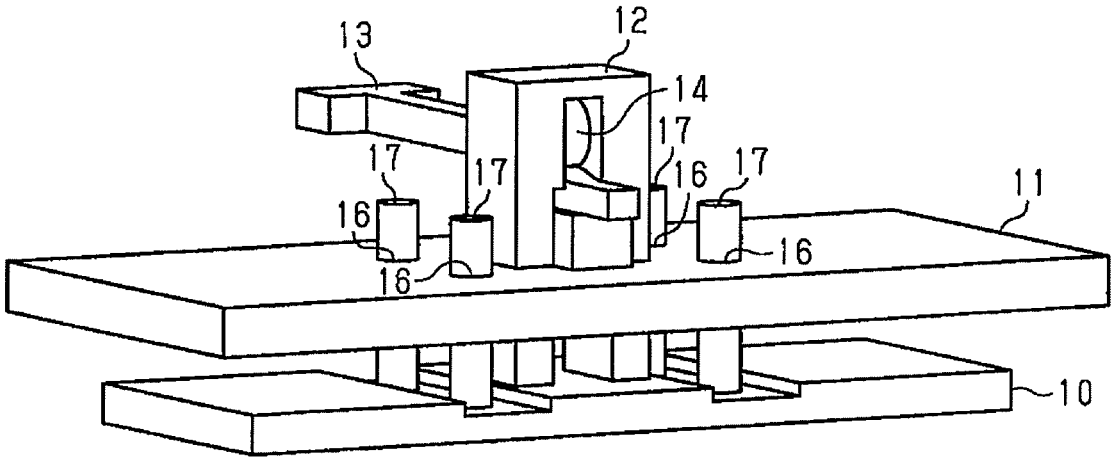
FIG. 2 is a perspective view showing the structure of the ejector and its surroundings in the apparatus.

FIG. 2 shows the ejector 10, the fixed block 11, and the support member 12 as seen from obliquely above. As shown in FIG. 2, the ejector 10 is a rectangular plate-shaped member. Guide posts 17 are fixed to parts of the upper surface of the ejector 10 that are separated from the support member 12 toward the opposite ends in the longitudinal direction of the ejector 10. The guide posts 17 protrude upward and pass through through-holes 16 of the fixed block 11 from below. When the ejector 10 moves vertically, the support member 12 and the guide post 17 move in the vertical direction relative to the fixed block 11.

As shown in FIG. 1, the upper table 8 is provided with a slider 13, which extends in a direction intersecting the support member 12 (the horizontal direction). The slider 13 supports the ejector 10 and the support member 12. More specifically, a roller 14 is rotationally supported by a part of the upper end of the support member 12 that is located above the slider 13. The roller 14 is coupled to the ejector 10 through the support member 12 so as to move integrally with the ejector 10. An urging mechanism 15 including a spring is provided between the ejector 10 and the fixed block 11. The roller 14 remains in contact with the upper surface of the slider 13 by the vertical urging force of the spring of the urging mechanism 15 and the gravity acting on the ejector 10 and the support member 12. In this way, the ejector 10 and the support member 12 are supported by the slider 13 of the upper table 8 with the roller 14.

The unprocessed material 4 is placed on the stripper 7 of the lower die assembly 2. Then, as the upper die assembly 3 is moved downward to perform clamping, the die 9 of the upper die assembly 3 pushes down the unprocessed material 4 and the stripper 7 while holding the unprocessed material 4 between the die 9 and the stripper 7. Through the pushing down of the unprocessed material 4, the punch 6 of the lower die assembly 2 punches out a workpiece upward from the unprocessed material 4 with the unprocessed material 4 held between the punch 6 and the ejector 10. At this time, the ejector 10 urges the unprocessed material 4 toward the punch 6 with the urging force of the spring of the urging mechanism 15, so that the workpiece is prevented from being deformed when being punched out from the unprocessed material 4.

When the punch 6 punches out the workpiece upward from the unprocessed material 4, the punched out workpiece fits into the die 9 of the upper die assembly 3 and the ejector 10 is retracted into the die 9. The workpiece manufacturing apparatus 1 is provided with a locking device 18. The locking device 18 locks the ejector 10 with respect to the upper die assembly 3 (the die 9) at the position where the punch 6 has punched out the workpiece from the unprocessed material 4 and releases the ejector 10 when the die assemblies 2, 3 are opened. The locking device 18 includes the slider 13, which is provided in the upper table 8 and movable in the horizontal direction, an actuator 19, which is provided in the upper table 8 to slide the slider 13, and a computer 20, which functions as a control section that controls the actuator 19.

The actuator 19 may be an air cylinder that includes a piston 21 and two pressure chambers 22, 23 partitioned by the piston 21. Air is either supplied to or discharged from the respective pressure chambers 22, 23 to displace the piston 21, so that a rod 24, which is connected to the piston 21, is extended or retracted. The rod 24 of the actuator 19 is connected to the slider 13, and the slider 13 is slid in the horizontal direction through extension and retraction of the rod 24. The two pressure chambers 22, 23 of the actuator 19 are connected to the pump 26 via a switching valve 25, the operation of which is controlled through the computer 20.

The computer 20 controls the operation of the switching valve 25 to supply air discharged from the pump 26 to the pressure chambers 22, 23 of the actuator 19 and to selectively discharge air from the pressure chambers 22, 23. Through supply and discharge of air to and from the pressure chambers 22, 23, it is possible to displace the piston 21 and the rod 24 of the actuator 19 and hold the position of the rod 24. This allows the slider 13 to be slid or held in a position in the horizontal direction.

The upper surface of the slider 13 is provided with a releasing surface 27, a slope 28, and a locking surface 29 in this order from the distal end in the protruding direction of the rod 24 (the right side as viewed in FIG. 1) in the actuator 19 toward the rod 24. The locking surface 29 is located at a higher level than the releasing surface 27, and the slope 28 is inclined with respect to the horizontal plane so as to connect the releasing surface 27 and the locking surface 29. When the slider 13 slides horizontally, the roller 14, contacting the upper surface of the slider 13, rolls along the releasing surface 27, the slope 28, and the locking surface 29.

When the punch 6 punches out the workpiece from the unprocessed material 4 in the clamped state of the manufacturing apparatus 1, the ejector 10 is retracted into the die 9 against the urging force of the spring in the urging mechanism 15. This displaces the roller 14, which moves integrally with the ejector 10, upward. At this time, when the rod 24 of the actuator 19 is extended to slide the slider 13 rightward as viewed in FIG. 1, the roller 14 comes into contact with the locking surface 29 of the slider 13. In this state, the locking surface 29 of the slider 13 pushes the roller 14 upward and compresses the spring of the urging mechanism 15 so that the ejector 10 is locked with respect to the die 9.

The position of the slider 13 when the roller 14 contacts the locking surface 29 will hereafter be referred to as a locking position. When the slider 13 is in the locking position, the ejector 10 is locked with respect to the die 9 at the position where the punch 6 punched out the workpiece from the unprocessed material 4.

When the rod 24 of the actuator 19 is retracted to slide the slider 13 leftward as viewed in FIG. 1 with the slider 13 in the locking position and the lower die assembly 2 and the upper die assembly 3 in the opened state, the roller 14 comes in contact with the slope 28 and the releasing surface 27 of the slider 13 in this order. When the roller 14 is in contact with the releasing surface 27, the urging force of the spring of the urging mechanism 15 is weakened as compared with that during compression, so that the ejector 10 is released with respect to the die 9. As a result, the ejector 10 is moved downward by the urging force of the spring of the urging mechanism 15 and the gravity acting on the ejector 10 and the support member 12 until the ejector 10 protrudes toward the lower die assembly 2 from the die 9.

The position of the slider 13 when the roller 14 contacts the releasing surface 27 will hereafter be referred to as a releasing position. When the slider 13 is in the releasing position, the ejector 10 is released with respect to the die 9 and protrudes downward from the die 9 when the lower die assembly 2 and the upper die assembly 3 are in the opened state. When such downward movement of the die 9 is performed with the workpiece fitted in the die 9, the workpiece is ejected from the die 9.

The urging mechanism 15 will now be described.

Figure 3:
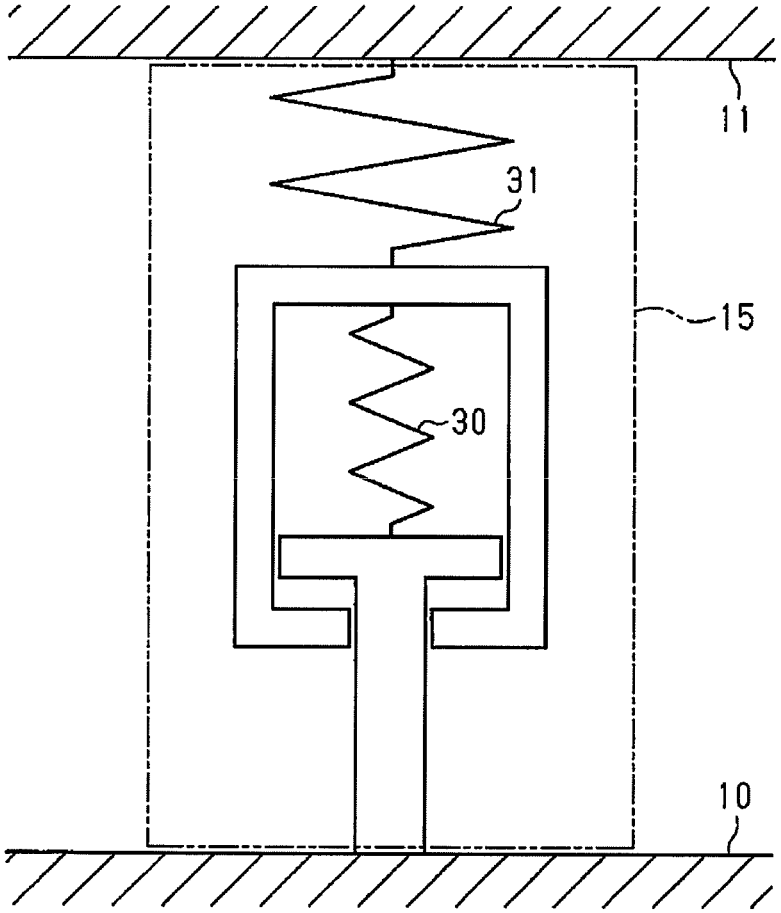
FIG. 3 is a schematic diagram conceptually illustrating the structure of the urging mechanism in the apparatus.

FIG. 3 conceptually illustrates the structure of the urging mechanism 15. As can be seen from FIG. 3, the spring of the urging mechanism 15 includes a first spring member 30 and a second spring member 31. The urging mechanism 15 is configured such that the first spring member 30 is compressed before the second spring member 31 when the ejector 10 is displaced upward relative to the fixed block 11 (when it is displaced in a direction away from the lower die assembly 2 in FIG. 1). The force required to compress the first spring member 30 is set to be smaller than the force required to compress the second spring member 31. The displacement amount of the first spring member 30 when compressed is set to be larger than the displacement amount of the second spring member 31 when compressed.

When the slider 13 shown in FIG. 1 is caused to slide from the releasing position to the locking position by the actuator 19, the force of the actuator 19 is set to the following magnitude. That is, the force of the actuator 19 is set to a magnitude that can push up the roller 14 against the urging force of the first spring member 30 along the slope 28 of the slider 13 and cannot push up the roller 14 against the urging force of the second spring member 31.

Therefore, when the slope 28 contacts the roller 14 through the sliding movement of the slider 13 and acts to push up the roller 14, the roller 14 can be pushed up until the first spring member 30 (FIG. 3) is compressed completely. When the first spring member 30 is compressed completely, the ejector 10 slightly protrudes downward with respect to the die 9. That is, the length of the first spring member 30 (corresponding to the maximum compression amount) is determined in advance in order to achieve such a state.

Even if the slope 28 pushes up the roller 14 to compress the second spring member 31 by sliding movement of the slider 13 toward the locking position after the first spring member 30 is compressed completely, the second spring member 31 cannot be compressed. Therefore, the sliding movement of the slider 13 is stopped in a state in which the roller 14 is in contact with the slope 28. That is, the length of the first spring member 30 and the vertical distance between the locking surface 29 and the releasing surface 27 are determined in advance such that the slider 13 stops in such a state.

An operation of the workpiece manufacturing apparatus 1 will now be described.

As shown in FIG. 1, the unprocessed material 4 is transferred to the space between the lower die assembly 2 and the upper die assembly 3 in the opened state and thereafter placed on the stripper 7 of the lower die assembly 2. At this time, the slider 13 has been slid to the releasing position, and the ejector 10 protrudes downward from the die 9. In this state, the slider 13 is slid from the releasing position toward the locking position. Then, the slope 28 of the slider 13 pushes up the roller 14 against the urging force of the first spring member 30 of the urging mechanism 15, so that the ejector 10 is displaced upward with respect to the die 9.

Figure 4:
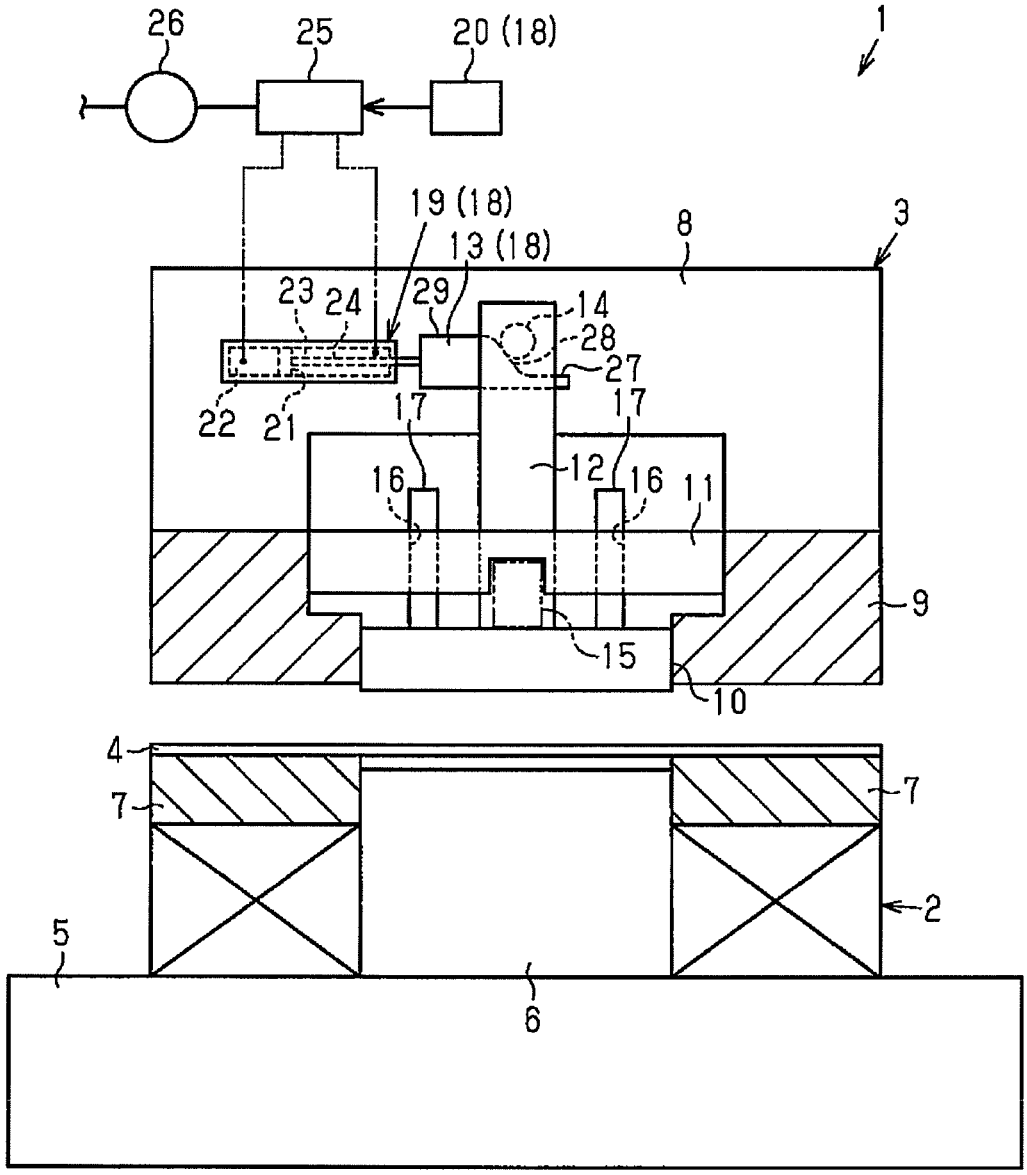
FIG. 4 is a schematic diagram showing the manufacturing process of a workpiece by the apparatus.

FIG. 4 shows the state of the ejector 10 when the first spring member 30 of the urging mechanism 15 is compressed completely by the upward displacement of the ejector 10 as described above. At this time, the force from the actuator 19 acts on the slider 13, but this force cannot compress the second spring member 31 of the urging mechanism 15, so that the sliding movement of the slider 13 is stopped with the roller 14 in contact with the slope 28. In this state, the upper die assembly 3 is moved downward, so that the unprocessed material 4 and the stripper 7 are pushed downward with the unprocessed material 4 held between the die 9 of the upper die assembly 3 and the stripper 7 of the lower die assembly 2. As a result, the unprocessed material 4 is also held between the punch 6 and the ejector 10.

Figure 5:
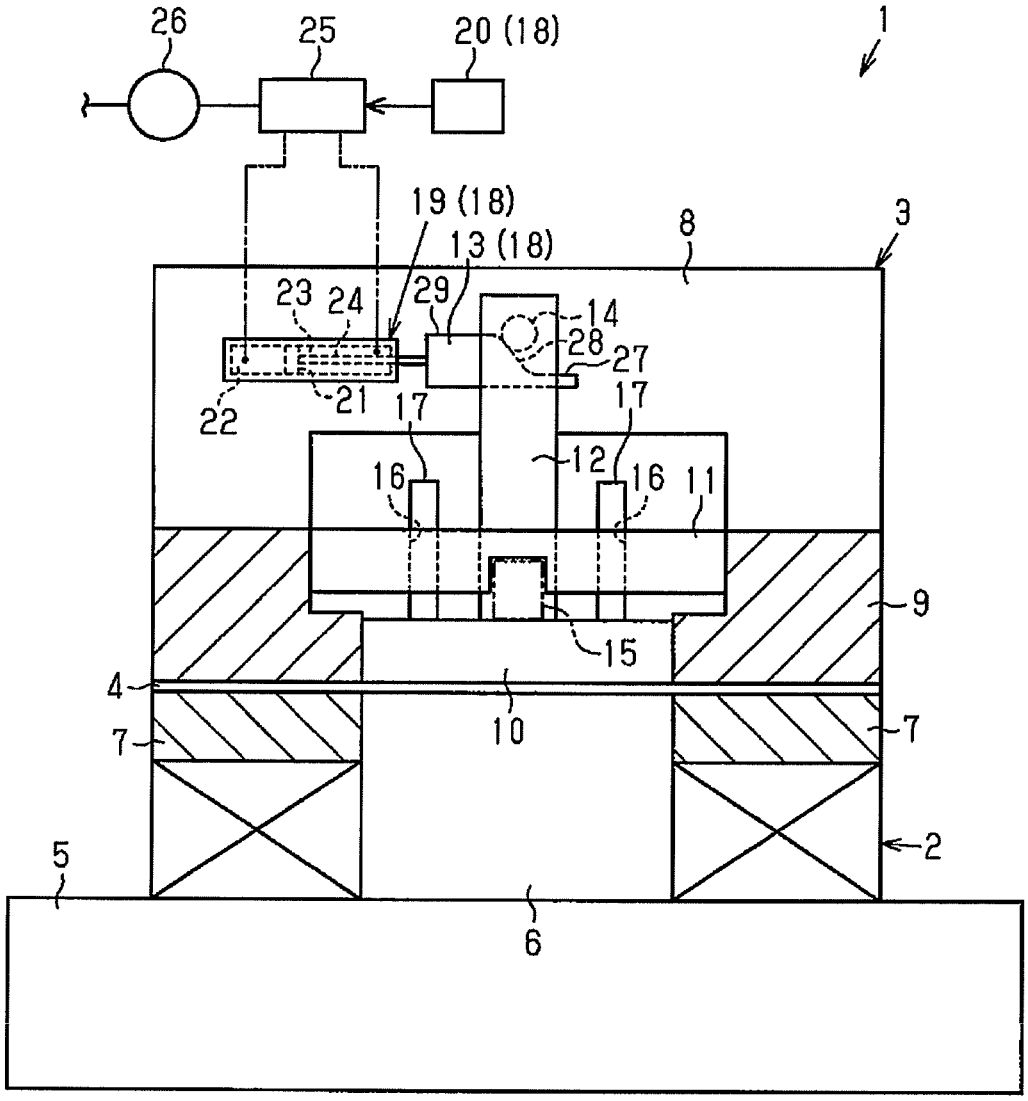
FIG. 5 is a schematic diagram showing the manufacturing process of a workpiece by the apparatus.

FIG. 5 shows a state in which the unprocessed material 4 is sandwiched between the punch 6 and the ejector 10. When the upper die assembly 3 is further moved downward in this state, the punch 6 of the lower die assembly 2 punches out the workpiece upward from the unprocessed material 4. At this time, the ejector 10 urges the unprocessed material 4 toward the punch 6 with the urging force of the second spring member 31 of the urging mechanism 15, so that the workpiece is prevented from being deformed when being punched out from the unprocessed material 4. The punched-out workpiece is fitted into the die 9 of the upper die assembly 3 and the ejector 10 is retracted into the die 9. At this time, the roller 14, moving integrally with the ejector 10, is displaced upward, so that the slider 13, on which the force of the actuator 19 acts, slides to the locking position. Accordingly, the locking surface 29 of the slider 13 pushes the roller 14 upward and compresses the second spring member 31 of the urging mechanism 15 so that the ejector 10 is locked with respect to the die 9.

Figure 6:
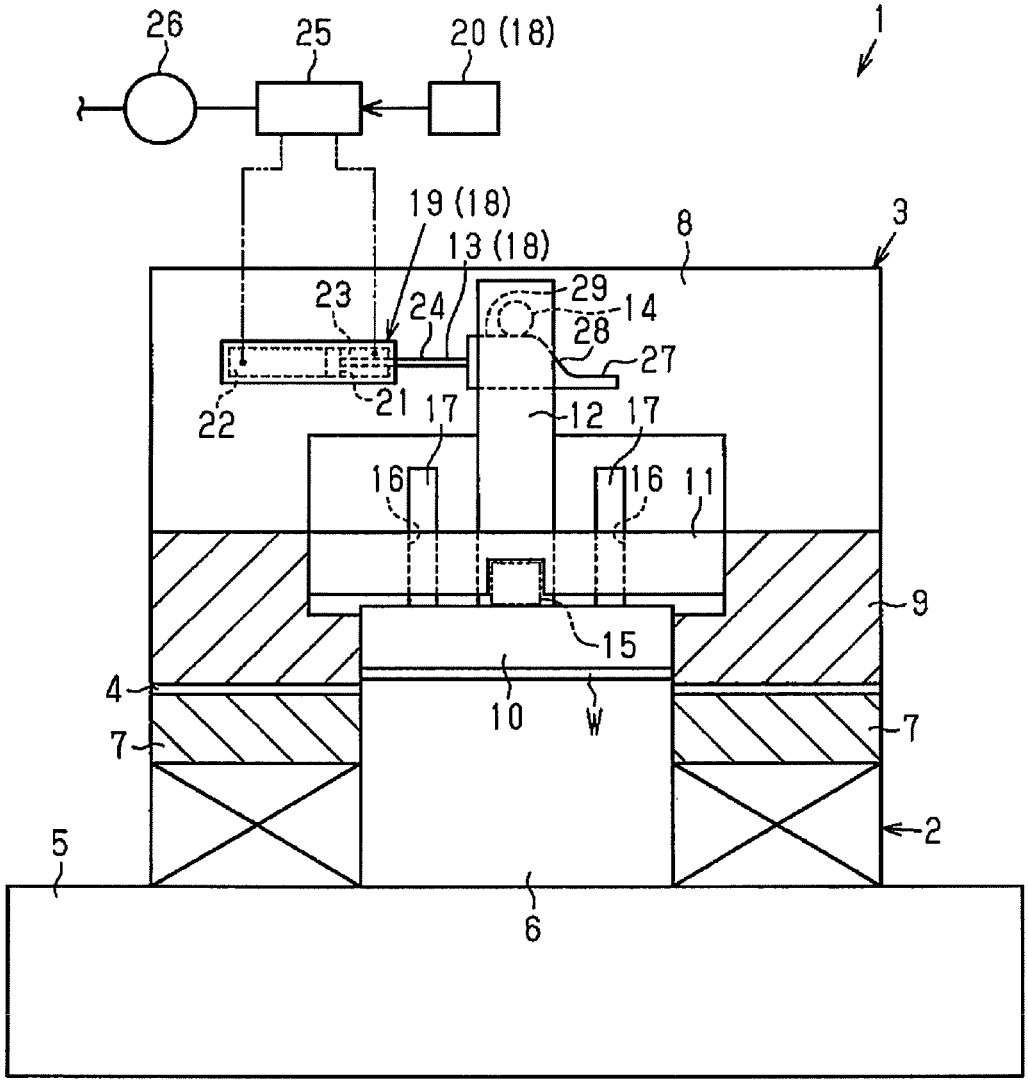
FIG. 6 is a schematic diagram showing the manufacturing process of a workpiece by the apparatus.
Figure 7:
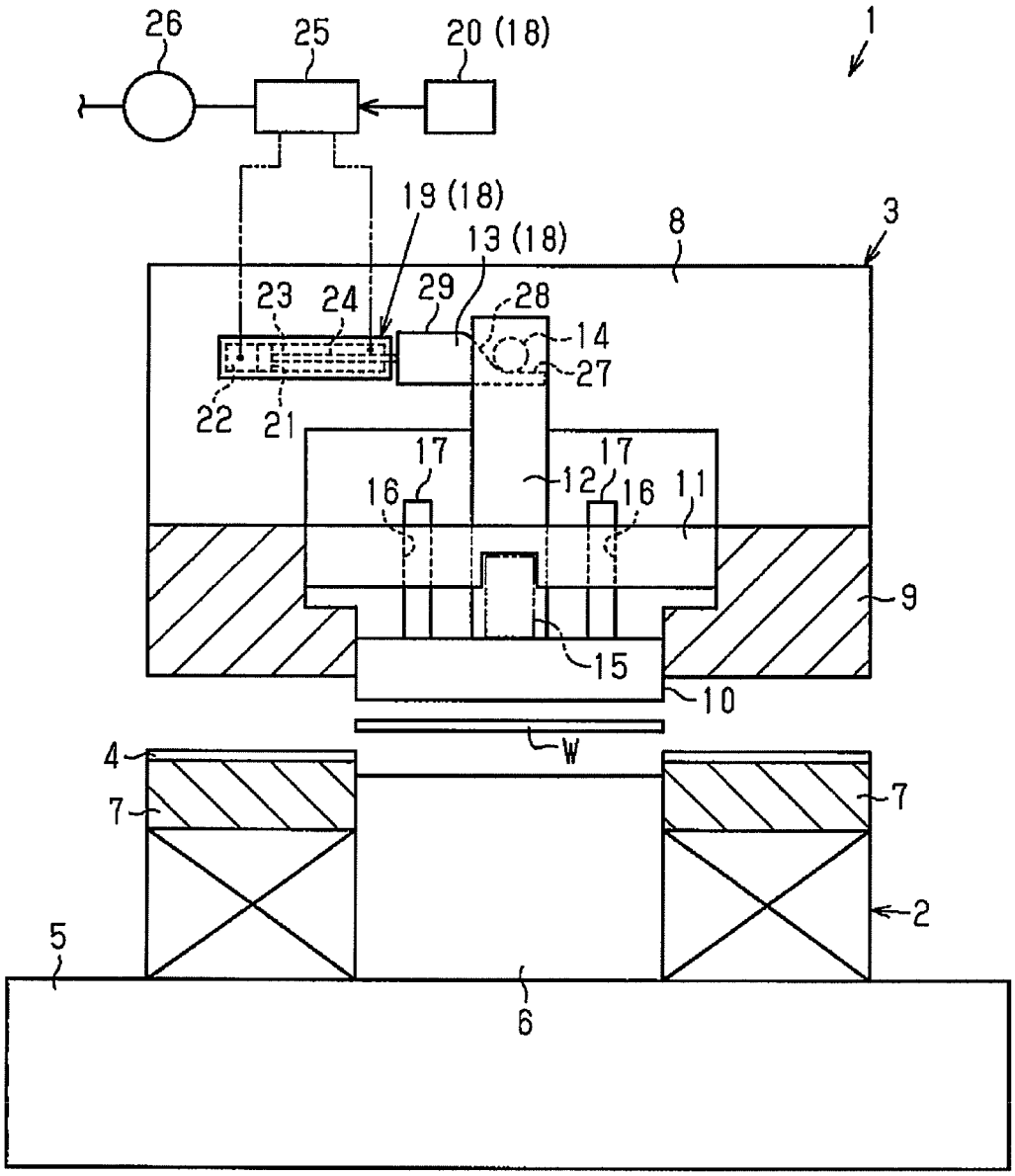
FIG. 7 is a schematic diagram showing the manufacturing process of a workpiece by the apparatus.

FIG. 6 shows a state in which the ejector 10 is locked with respect to the die 9. In this state, the upper die assembly 3 moves upward, thereby opening the lower die assembly 2 and the upper die assembly 3. When the slider 13 is slid from the locking position to the releasing position by the actuator 19 with the lower die assembly 2 and the upper die assembly 3 in the opened state, the ejector 10 is released with respect to the die 9. As a result, the urging force of the second spring member 31 and the urging force of the first spring member 30 of the urging mechanism 15 push the ejector 10 downward from the die 9 toward the lower die assembly 2 as shown in FIG. 7. Accordingly, the workpiece W fitted in the die 9 is ejected.

The above-described embodiment has the following advantages.

(1) The slider 13 of the locking device 18 slides through the control of the actuator 19 by the computer 20, and the actuator 19 is provided in the upper die assembly 3. Therefore, it is unnecessary to use a dedicated locking device adapted to the movement of opening for each workpiece manufacturing apparatus, and the common locking device 18 can be used for different manufacturing apparatuses. This increases the versatility of the locking device 18.

(2) The unprocessed material 4 and the workpiece are thin plates, for example, when manufacturing a separator provided in the cell stack of a fuel cell with the manufacturing apparatus 1. In such a case, to eject the workpiece fitted in the die 9 in the opened state, the amount of displacement of the ejector 10 is preferably large. Otherwise, the workpiece may not be ejected properly.

To ensure a large amount of displacement of the ejector 10 when ejecting the workpiece, the length of the spring of the urging mechanism 15 may be increased. This, however, may cause the following problems. That is, the amount of protrusion of the ejector 10 from the die 9 increases in accordance with the elongation of the spring when the lower die assembly 2 and the upper die assembly 3 are clamped. Accordingly, there is a possibility that the ejector 10 is pressed by the urging force of the spring at a time considerably earlier than the time at which the punch 6 makes contact with the unprocessed material 4. In this case, the urging force of the spring acting on the unprocessed material 4 via the ejector 10 may adversely affect the unprocessed material 4 before the workpiece is punched out.

In this respect, the manufacturing apparatus 1 is configured such that the urging mechanism 15 is provided with the first spring member 30 and the second spring member 31, and that the first spring member 30 is compressed prior to the second spring member 31 at the time of clamping. The use of the first spring member 30 and the second spring member 31 increases the displacement amount of the ejector 10 when ejecting the workpiece from the die 9. The displacement amount of the first spring member 30 during compression (corresponding to the displacement amount during expansion) is set to be larger than the displacement amount of the second spring member 31 during compression. The displacement amount is preferably set to a value that allows a thin plate-like workpiece to be reliably ejected from the die 9 as described above.

Furthermore, the force of the actuator for sliding the slider 13 from the releasing position to the locking position is set to be greater than the urging force of the first spring member 30 and smaller than the urging force of the second spring member 31. When the lower die assembly 2 and the upper die assembly 3 are clamped, the actuator 19 is operated through the computer 20 such that the slider 13 slides from the releasing position to the locking position.

As a result, the slope 28 of the slider 13 pushes up the roller 14 against the urging force of the first spring member 30 of the urging mechanism 15. However, when the first spring member 30 is compressed completely, the second spring member 31 cannot be compressed even if the slope 28 of the slider 13 pushes up the roller 14 in an attempt to compress the second spring member 31, and the sliding movement of the slider 13 is stopped. At this time, the roller 14 is in contact with the slope 28 of the slider 13.

The lower die assembly 2 and the upper die assembly 3 are clamped in a state in which the first spring member 30 is compressed completely and the protruding amount of the ejector 10 from the die 9 is suppressed to a small amount. Therefore, at the time of clamping the lower die assembly 2 and the upper die assembly 3, the ejector 10 is not pressed against the unprocessed material 4 by the urging force of the first spring member 30. Thus, the urging force is prevented from adversely affecting the unprocessed material 4 before the workpiece is punched out.

(3) The ejector 10, formed in a rectangular plate-like shape, is supported by the support member 12, which projects upward from the center of the ejector 10. This may inflect the ejector 10 in the longitudinal direction so that the opposite ends in the longitudinal direction of the ejector 10 droop. However, such inflection of the ejector 10 is suppressed by the guide posts 17, which protrude upward from the upper surface of the ejector 10, and the through-holes 16 of the fixed block 11, through which the guide posts 17 pass. That is, when the ejector 10 acts to be inflected as described above, the outer circumferential surfaces of the guide posts 17 contact the inner circumferential surfaces of the through-holes 16. This suppresses the occurrence of such inflection.

The above-described embodiment may be modified as follows.

The workpiece does not necessarily need to be a thin plate.

When the workpiece is not a thin plate, the urging mechanism 15 does not need to have the first spring member 30 and the second spring member 31, but may include a single spring member.

The vertical relationship of the lower die assembly 2 and the upper die assembly 3 may be reversed.

In place of an air cylinder, for example, a motor may be employed as the actuator 19.

The invention claimed is:

1. A workpiece manufacturing apparatus comprising:

an upper die assembly and a lower die assembly, which are arranged on opposite sides of an unprocessed material, wherein the upper and lower die assemblies are moved relative to each other toward each other to be clamped and moved relative to each other away from each other to be opened;

a punch, which is provided in the lower die assembly and punches out a workpiece from the unprocessed material in a clamped state of the die assemblies;

an ejector, which is provided in the upper die assembly so as to be capable of approaching and moving away from the lower die assembly and to be located at a position corresponding to the punch;

a spring, which is provided in the upper die assembly and urges the ejector toward the lower die assembly; and a locking device, which locks the ejector with respect to the upper die assembly at a position at which the punch punches out the workpiece from the unprocessed material and releases the ejector when the die assemblies are opened, wherein the locking device comprises:

a slider, which is provided in the upper die assembly and is capable of sliding between a locking position, at which the ejector is locked, and a releasing position, at which the ejector is released, an actuator, which is provided in the upper die assembly and causes the slider to slide, and a control section, which controls the actuator, a roller being provided above the ejector, the roller being coupled to the ejector to be capable of moving integrally with the ejector, the roller being in contact with the slider by an urging force of the spring acting on the ejector, the slider slides in a horizontal direction between the locking position and the releasing position, the slider comprising:

a releasing surface, which contacts the roller when the slider is in the releasing position, a locking surface, which is located at a higher level than the releasing surface, the roller contacting the locking surface when the slider is in the locking position, and a slope, which connects the releasing surface and the locking surface with each other, when the slider is in the locking position, the roller is pressed by the locking surface to compress the spring, thereby locking the ejector with respect to the upper die assembly, and when the slider is in the releasing position, the releasing surface is caused to contact the roller to weaken the urging force of the spring as compared with that during the compression, thereby releasing the ejector.

2. The workpiece manufacturing apparatus according to claim 1, wherein the spring is configured by a first spring member and a second spring member provided in an urging mechanism, which urges the ejector toward the lower die assembly, the urging mechanism is configured to compress the first spring prior to the second spring when the ejector is displaced away from the lower die assembly, a force required to compress the first spring member is smaller than a force required to compress the second spring member, a displacement amount of the first spring member during compression is larger than a displacement amount of the second spring member during compression, a force with which the actuator slides the slider from the releasing position to the locking position is set to a magnitude that can push up the roller against the urging force of the first spring member along the slope of the slider and cannot push up the roller against the urging force of the second spring member, and when the upper die assembly and the lower die assembly are clamped, the control section operates the actuator to slide the slider from the releasing position to the locking position.

* * * * *